US008047881B2

(12) United States Patent
Wang

(10) Patent No.: US 8,047,881 B2
(45) Date of Patent: Nov. 1, 2011

(54) CONNECTOR BASE

(75) Inventor: Wei-Jun Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 69 days.

(21) Appl. No.: 12/641,610

(22) Filed: Dec. 18, 2009

(65) Prior Publication Data

US 2011/0097940 A1 Apr. 28, 2011

(30) Foreign Application Priority Data

Oct. 27, 2009 (CN) ..... 2009 1 0308890

(51) Int. Cl.
*H01R 9/22* (2006.01)

(52) U.S. Cl. ..... 439/717

(58) Field of Classification Search ..... 439/650, 439/415, 717, 534, 358, 74, 66
See application file for complete search history.

(56) References Cited

U.S. PATENT DOCUMENTS

| | | | | |
|---|---|---|---|---|
| 3,042,895 | A * | 7/1962 | Bonhomme | 439/701 |
| 3,771,104 | A * | 11/1973 | Clark | 439/415 |
| 4,611,879 | A * | 9/1986 | Bullard | 439/717 |
| 5,180,311 | A * | 1/1993 | Schreiber et al. | 439/74 |
| 5,299,939 | A * | 4/1994 | Walker et al. | 439/74 |
| 7,413,481 | B2 * | 8/2008 | Redmond et al. | 439/717 |
| 7,625,250 | B2 * | 12/2009 | Blackwell | 439/717 |
| 2009/0318016 | A1 * | 12/2009 | Poulakis | 439/534 |

* cited by examiner

*Primary Examiner* — Edwin A. Leon
(74) *Attorney, Agent, or Firm* — Altis Law Group, Inc.

(57) ABSTRACT

A connector base includes an assembly plate and a plug plate. The assembly plate defines a plurality of assembly holes. The plug plate includes a plurality of plug units, a plurality of plug portions, and a plurality of elastic members. The plug portions are formed on the plug units respectively. The plug portions engage in the assembly holes of the assembly plate. The elastic members connect the two plug units.

13 Claims, 4 Drawing Sheets

CONNECTOR BASE

BACKGROUND

1. Technical Field

The present disclosure relates generally to connectors and, more particularly, to a connector base for an electronic device.

2. Description of Related Art

A computer generally includes a housing for protecting a plurality of inner components, such as a hard disk and a motherboard. A connector base is generally disposed on a side wall of the housing. The inner components are electrically connected to the connector base. Peripheral components, such as a keyboard and a display, are electrically connected through the connector base to the inner components.

Referring to FIG. 4, a commonly used connector base 10 includes an assembly plate 11 and a plug plate 13. The assembly plate 11 defines a plurality of assembly holes 111, and the plug plate 13 forms a plurality of plug portions 131 engaging in the assembly holes 111 of the assembly plate 11.

However, the machining precision of the plug plate 13 must be exact, such that the plug portions 131 smoothly engage in the assembly holes 111 of the assembly plate 11. If one plug portion 131 deviates from a predetermined position of the plug plate 13, the plug portions 131 cannot engage in the assembly holes 111 of the assembly plate 11.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
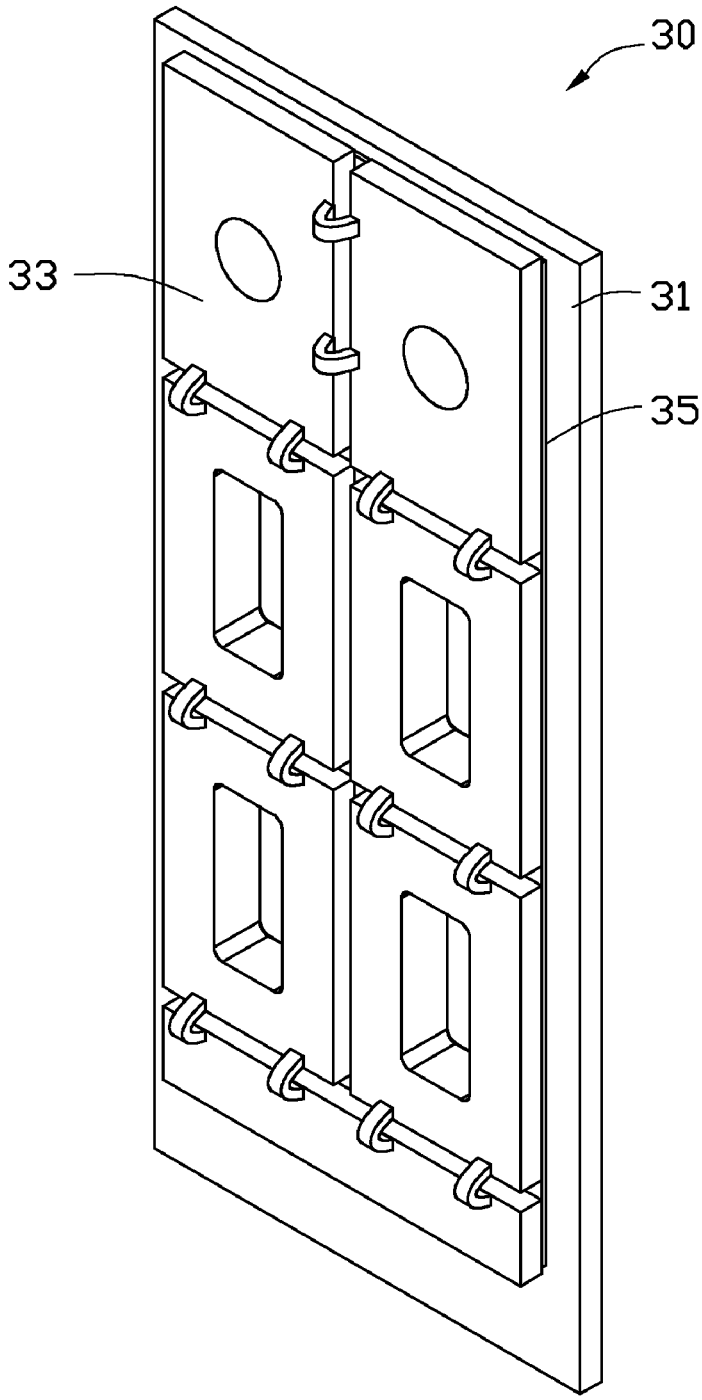
FIG. 1 is an isometric view of an embodiment of a connector base.

Referring to FIG. 1, an embodiment of a connector base 30 includes an assembly plate 31, a plug plate 33, and an adhesive member 35 disposed between the assembly plate 31 and the plug plate 33.

Figure 2:
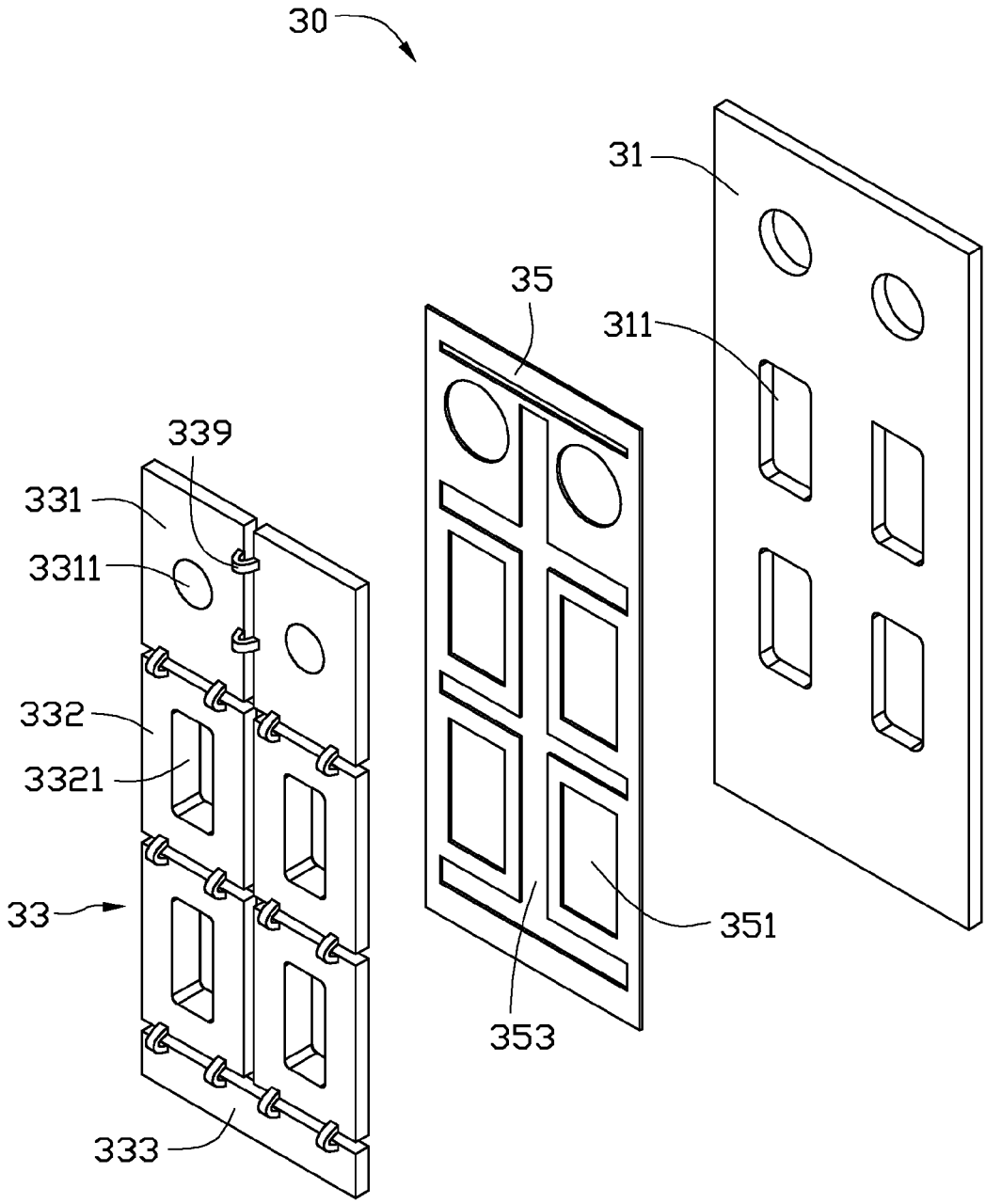
FIG. 2 is an exploded, isometric view of the connector base of FIG. 1.
Figure 3:
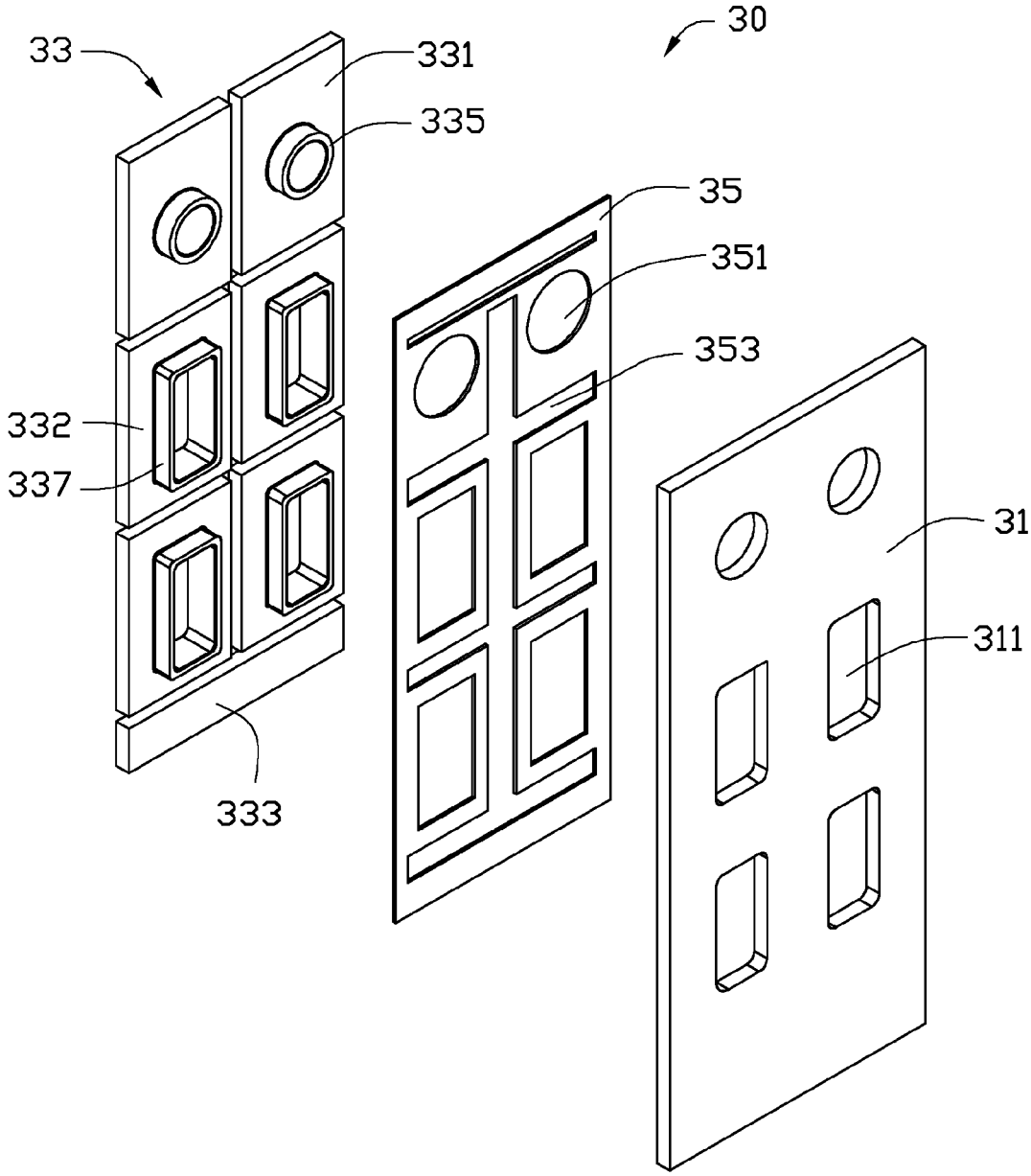
FIG. 3 is similar to FIG. 2, but viewed from another aspect.
Figure 4:
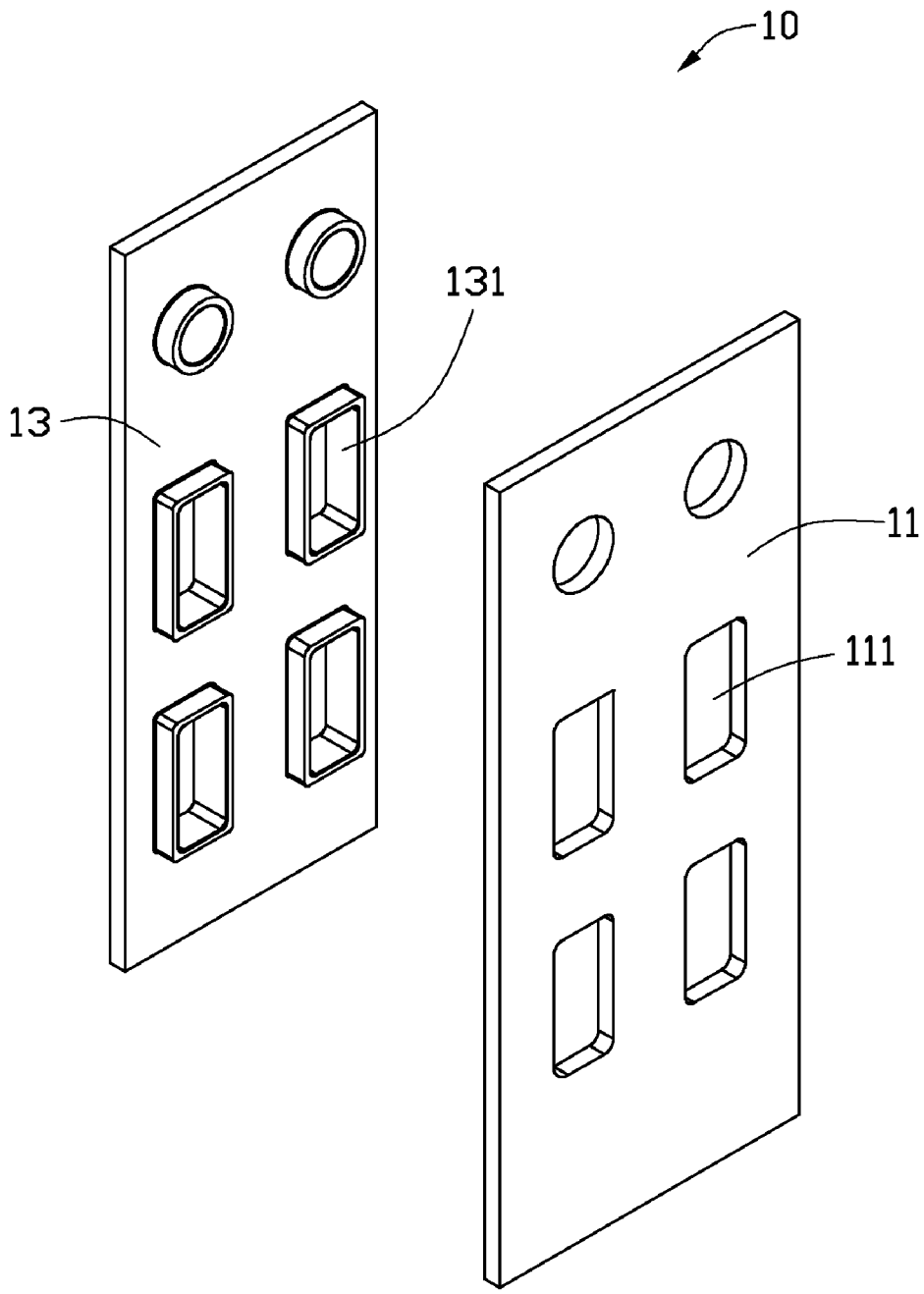
FIG. 4 (PRIOR ART)
FIG. 4 is an isometric view of a commonly used connector base.

Referring to FIGS. 2 and 3, the assembly plate 31 can be a metal plate, such as steel, and defines a plurality of assembly holes 311. In the illustrated embodiment, the assembly plate 31 is substantially rectangular, and defines two circular assembly holes 311 in an end, and four rectangular assembly holes 311 side by side in a middle portion.

The plug plate 33 includes a plurality of first plug units 331, a plurality of second plug units 332, a plate portion 333, a plurality of first plug portions 335, a plurality of second plug portions 337, and a plurality of elastic members 339. The first plug portions 335 are disposed on the first plug units 331, and the second plug portions 337 are positioned on the second plug units 332. The elastic members 339 connects a first or second plug unit 331, 332 with each other, or the plate portion 333. In the illustrated embodiment, the plug plate 33 includes two first plug units 331 and four second plug units 332 side by side. The first plug units 331 are rectangular plates, and each first plug unit 331 defines a first connecting hole 3311. The first plug portions 335 are annular protrusions extending from the first plug units 331 around the first connecting holes 3311. The second plug units 332 are rectangular plates, and each second plug unit 332 defines a second connecting hole 3321. The second plug portions 337 are rectangular annular protrusions extending from the second plug units 332 around the first connecting holes 3321. The first plug units 331, the second plug units 332, the plate portion 333, the first plug portions 335, and the second plug portions 337 can be made of plastic. The elastic members 339 can be curved and made of plastic, so that the elastic members 339 is flexible within a predetermined range.

The adhesive member 35 is shaped according to the plug plate 33 and the assembly plate 31. The adhesive member 35 defines a plurality of through holes 351 corresponding to the first plug portions 335 and the second plug portions 337, and a groove 353 corresponding to a space between the first plug units 331, the second plug units 332, and the plate portion 333. In the illustrated embodiment, the adhesive member 35 is a double-sided adhesive.

During assembly of the connector base 30, the adhesive member 35 is attached to the plug plate 33, with the first plug portions 335 and the second plug portions 337 engaging in the through hole 351 of the adhesive member 35. The assembly plate 31 is attached to the adhesive member 35, and the first plug portions 335 and the second plug portions 337 extend through the assembly holes 311 of the assembly plate 31.

The first plug units 331 and the second plug units 332 can move relative to each other by a small displacement, because the elastic members 339 are flexible. Thus, since the first plug portions 335 and the second plug portions 337 can be seated into the assembly holes 311 of the assembly plate 31 smoothly, the plug plate 33 does not need to be precisely manufactured. That is, the plug plate 33 is easily made. In addition, the plug plate 33 can be made of plastic and thus can be integrally formed by molding. Accordingly, a manufacturing efficiency of the plug plate 33 is high and a manufacturing cost of the plug plate 33 is relatively low. The adhesive member 35 is sandwiched between the assembly plate 31 and the plug plate 33 to improve mechanism strength of the connector base 30.

It should be pointed out that the elastic members 339 may be made of other materials, such as metal elastic pieces. In that case, the elastic members 339 are first positioned in the mold, and melted plastic material injected into the mold to form the plug plate 33. In addition, the plug plate 33 may include only two plug units, with two plug portions respectively formed on the plug units, and one or more elastic members 339 connecting the plug units.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A connector base, comprising:

an assembly plate defining at least two assembly holes; and a plug plate, comprising:

at least two plug units;

at least two plug portions formed on the at least two plug units respectively, the at least two plug portions engaging in the at least two assembly holes of the assembly plate; and at least one elastic member connecting the at least two plug units, such that the at least two plug units are capable of moving relative to each other by a small displacement, to make the at least two plug portions smoothly engage in the at least two assembly holes of the assembly plate.

2. The connector base of claim 1, further comprising an adhesive member positioned between the assembly plate and the plug plate.

3. The connector base of claim 2, wherein the adhesive member is double-sided adhesive.

4. The connector base of claim 1, wherein the assembly plate is a metal plate.

5. The connector base of claim 1, wherein the plug plate is made of plastic.

6. The connector base of claim 1, wherein the elastic member is curved, and opposite ends of the elastic member are connected to the plug units.

7. The connector base of claim 1, wherein each of the at least two plug units defines a connecting hole, and the at least two plug portions are formed on the at least two plug units surrounding the connecting holes.

8. The connector base of claim 7, wherein the at least two plug portions are annular.

9. The connector base of claim 7, wherein the at least two plug portions are rectangularly annular shaped.

10. The connector base of claim 1, wherein the at least two plug units, the at least two plug portions, and the at least one elastic member are integrally formed.

11. The connector base of claim 1, wherein the plug plate further comprises a plate portion connecting with the at least two plug units.

12. The connector base of claim 2, wherein the adhesive member defines at least two through holes, the at least two plug portions extending through the at least through holes respectively.

13. The connector base of claim 1, wherein the at least two plug units are arranged side by side.

* * * * *